US009450304B1

(12) United States Patent
Edalati et al.

(10) Patent No.: US 9,450,304 B1
(45) Date of Patent: Sep. 20, 2016

(54) BEAM SWITCHING ANTENNA BASED ON FREQUENCY SELECTIVE SURFACES

(71) Applicants: ELLUMEN, INC., Arlington, VA (US); Arezou Edalati, Arlington, VA (US)

(72) Inventors: Arezou Edalati, Arlington, VA (US); Tayeb Ahmed Denidni, Montréal (CA)

(73) Assignees: Arezou Edalati, Arlington, VA (US); ELLUMEN, INC., Arlington, VA (US)

( * ) Notice: Subject to any disclaimer, the term of this patent is extended or adjusted under 35 U.S.C. 154(b) by 548 days.

(21) Appl. No.: 14/012,497

(22) Filed: Aug. 28, 2013

Related U.S. Application Data

(60) Provisional application No. 61/768,762, filed on Feb. 25, 2013.

(51) Int. Cl.
*H01Q 3/00* (2006.01)
*H01Q 3/34* (2006.01)
*H01Q 15/00* (2006.01)

(52) U.S. Cl.
CPC ..... *H01Q 3/34* (2013.01); *H01Q 15/0013* (2013.01)

(58) Field of Classification Search
CPC ..... H01Q 3/34; H01Q 15/0013
USPC ..... 342/372
See application file for complete search history.

(56) References Cited

U.S. PATENT DOCUMENTS 5,663,639 A * 9/1997 Brown ..... H01L 31/0232 250/214 A
7,893,882 B2 2/2011 Shtrom

FOREIGN PATENT DOCUMENTS

CN 102570034 A 7/2012
CN 102646869 A 8/2012

OTHER PUBLICATIONS

M. Chryssomallis, "Smart antennas," IEEE Antennas Propag. Mag., vol. 42, No. 47, pp. 129-136, 2000.
M-I. Lai, T.-Y. Wu, J.-C. Hsieh, C.-H. Wang, and S.-K. Jeng, "Compact switched-beam antenna employing a four-element slot antenna array for digital home applications," IEEE Trans. Antennas Propag., vol. 56, No. 9, pp. 2929-2636, 2008.
A. Alexiou and M. Haardt, "Smart antenna technologies for future wireless systems: Trends and challenges," IEEE Commun. Mag., pp. 90-97, Sep. 2004.

(Continued)

*Primary Examiner* — Frank J McGue
(74) *Attorney, Agent, or Firm* — Foley & Lardner LLP

(57) ABSTRACT

A directional beam switching antenna capable of transmitting/receiving in six directions with 60 degree beam width in six steps. The antenna advantageously uses frequency selective surfaces to block radiation of electromagnetic (EM) waves in unwanted directions and promote transmission of the EM waves in one or more selected directions. The frequency selective surface is made of a single layer of repeated metallic strips and active elements. In the preferred embodiment, only fifteen active elements are used in each of six sections of the antenna, thereby providing a simple, low cost design. The frequency selective surfaces have a high reflection co-efficient when the active elements are in their On state, and a high transmission co-efficient when the elements are in their Off state. Directional transmission is achieved by controlling the state of the active elements.

18 Claims, 16 Drawing Sheets

(56) References Cited

OTHER PUBLICATIONS

G. Cerri, R. D. Leo, V.M. Primiani, C. Monteverde, and P. Russo, "Design and prototyping of a switching beam disc antenna for wideband communications," IEEE Trans. Antennas Propag., vol. 54, No. 12, pp. 3721-3726, 2006.

B. A. Munk, Frequency Selective Services Theory and Design. New York: Wiley, 2000.

R. J. Mittra, C. H. Chan and T. A. Cwik, "Techniques for analyzing frequency selective surfaces—A review," Proc. IEEE, vol. 76, pp. 1593-1615, Dec. 1988.

J. P. Montgomery, "Scattering by an infinite periodic array of thin conductors on a dielectric sheet," IEEE Trans. Antennas Propag., vol. 23, pp. 70-75, Jan. 1975.

H. A. Kalhor, "Electromagnetic scattering by a dielectric slab loaded with a periodic array of strips over a ground plane," IEEE Trans. Antennas Propag., vol. 36, pp. 147-151, Jan. 1988.

A. Edalati et al., "Beam-switching Antenna Based on Active Frequency Selective Surfaces," IEEE , Department of Telecommunications, pp. 2254-2257, Jul. 2011.

A. Edalati et al., "Frequency Selective Surfaces for Beam-Switching Applications," IEEE Trans. Antennas Propag., vol. 61, No. 1, pp. 195-200, Jan. 2013.

E. Wang et al., "A electronically steerable radiator and reflector array antenna based on Three-Diemensional Frequency Selective Structure," $5^{th}$ Global Symposium on Millimeter Waves, Harbin, China, pp. 119-122, May 2012.

L. Zhang et al., "A Novel Reconfigurable Antenna Based on Active Band Reflective Frequency Selective Surface," IEEE, School of Electronics and Information Engineering, Harbin Institute of Technology, Harbin, Heilongjiang, China, 2012.

Y-L Tsai et al., "A Reconfigurable Beam-Switching Antenna Base on Active FSS," Department of Electrical Engineering, National Chiao Tung University, Hsinchu, Taiwan, 2012.

M. Hajj et al., "Dual-Band EBG Sectoral Antenna Using a Single-Layer FSS for UMTS Application," IEEE Antennas and Wireless Propag. Letters, vol. 8, pp. 161-164, 2009.

W. Iiangyi et al., "Reconfigurable Sectoral Antenna Using An Cylindrical Frequency Selective Surface," School of Electronic Engineering, University of Electronic Science and Technologu of China, Chengdu, China, 2012.

* cited by examiner

BEAM SWITCHING ANTENNA BASED ON FREQUENCY SELECTIVE SURFACES

CROSS-REFERENCE TO RELATED PATENT APPLICATIONS

This application claims priority to U.S. provisional application 61/768,762, filed Feb. 25, 2013, whose entire contents are incorporated herein by reference.

BACKGROUND OF THE INVENTION

The present invention relates generally to antennas, and more specifically to switched beam antennas, beam scanning antennas, and smart antennas. Such antennas are used, for example, in cellular or radio-frequency communication systems, indoor local area networks, military and surveillance applications, radars, and numerous other applications.

The two main components in a cellular, or radio frequency, communications system are the base station and the mobile station. In typical cellular systems, geographically defined areas are referred to as cells, and there is one base station in each cell. All mobile stations that are within the cell, communicate with the base station. The mobile stations communicate wirelessly with the base station, and the base station interfaces with a wired network for continued communications over the Internet, or over the plain old telephone system (POTS). The mobile stations communicate with the base station until they leave the geographical area defined by the cell. When the mobile station travels outside of the cell, the mobile station enters the range of another cell and starts communicating with another base station through a procedure known as hand-off, which occurs between the old and new base stations.

New cellular communication systems are finding use in smaller areas, such as indoors, and are being asked to handle more subscribers. Demands for low cost, high quality, robust and high data rate communication systems are increasing rapidly. Fortunately, wireless communication technology continues to grow quickly. Novel technologies have been employed to enhance the quality and functionality of these wireless systems. One of these novel technologies which has been employed recently and received lots of attention are beam switching antennas. Beam switching antennas are one of the smart antenna technologies and have found use in recent wireless communication systems. They allow for energy savings, decreasing multipath fading by directing the desired signal toward the appropriate user, and adding more flexibility to the antenna, thereby, increasing functionality of the antenna, leading to good transmission quality.

There are various methods for designing beam switching antennas. For instance, a conventional phased antenna array was a promising solution for beam switching and beam steering applications. However, complex power distribution networks and phase shifters are needed which greatly increases the size and price of such designs. Another attempted solution is using a Butler matrix, but integration of the matrix with an antenna array also is complex, requiring a large amount of space and inflating the price. Recently, active EBG structures have been used for designing reconfigurable antennas with switching characteristics. However, these systems employ a large number of active elements which increases power consumption, cost, complexity of the fabrication and maintenance.

SUMMARY OF THE INVENTION

The present invention solves drawbacks and problems occurring in other beam switching antenna systems. The present invention is a novel design of a low cost, low power, beam switching antenna based on reconfigurable frequency selective surfaces (FSSs). The present design advantageously provides a beam switching antenna based on active frequency selective surfaces (FSSs) which provide a wide bandwidth, high gain, and the capability of switching the direction of the main beam over the entire azimuth plane, of 360 degrees, using six steps of operation. The antenna provides a 60-degree beam width in the azimuth plane, in each of six sections, to avoid scanning blindness. In addition, the antenna requires only a minimal number of active elements, resulting in low power requirements, easy maintenance, and low cost.

The advantages of the present antenna design as compared to the previous pattern reconfigurable antennas include the use of only one layer of FSS with the shortest possible height instead of multiple layers. Using only one layer of a FSS allows for less active elements, lower cost, less complexity in terms of the fabrication, and easier maintenance. The present design uses less number of active elements than are used in other current beam switching antenna systems, thereby reducing the power requirements. Beam switching is achieved with electronic modification of the antenna configuration. Therefore, no mechanical modifications are required to scan the radiation pattern beam. The present invention provides the capability of switching the direction of the main beam from a remote location. Moreover, the switching can be based on the subscriber distribution, or towards a temporary hotspot area. The present antenna also provides the ability to increase cell capacity by modifying the antenna configuration in response to subscriber distribution and customer demands.

BRIEF DESCRIPTION OF THE DRAWINGS

An embodiment will now be described in more detail with reference to the accompanying drawings, given only by way of example, in which.

DETAILED DESCRIPTION OF EMBODIMENTS OF THE INVENTION

Presented herein is a novel design for a beam-switching antenna based on reconfigurable frequency selective surfaces (FSSs). FSSs are periodic structures composed of arrays of substantially identical elements with frequency dependent reflection and transmission coefficients. The FSSs are advantageously employed herein to direct incident electromagnetic waves.

Figure 1:
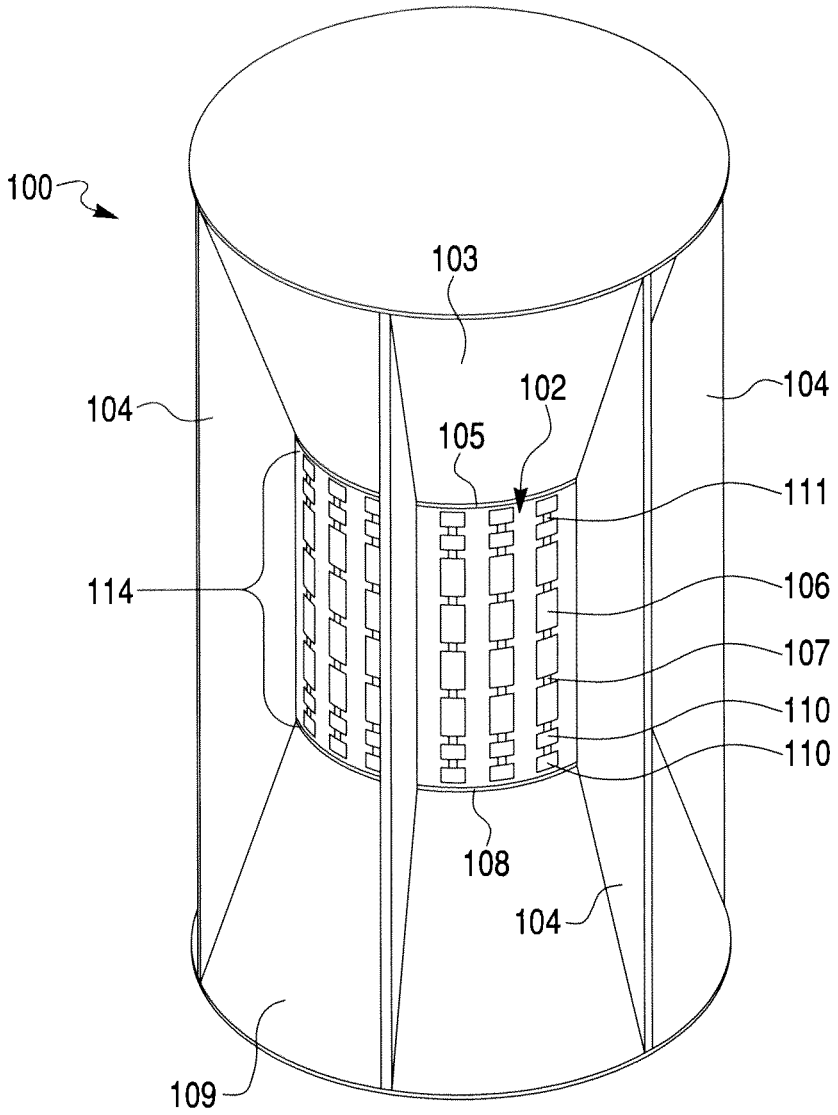
FIG. 1 is a perspective view of one embodiment of the present beam switching antenna.

FIG. 1 illustrates an operational beam switching antenna 100 embodying certain concepts of the present invention. The preferred embodiment of the beam switching antenna 100 comprises a cylindrical frequency selective surface (FSS) 102 constructed around a dipole (shown in FIGS. 2A and 2D) or other omnidirectional antenna, which is used as an excitation source. The cylindrical FSS 102 is divided into six sections using six metallic sheets 104, and two metallic cones 103 and 109. Metallic cone 103 is placed on top of the cylindrical FSS 102, and metallic cone 109 is placed at the bottom of the cylindrical FSS 102. Each metallic sheet 104 is placed along on the exterior of the cylindrical FSS 102 and runs along the length of the cylinder and of each cone 103 and 109, thereby creating the six sections of the antenna 100. As will be discussed further below, each section of the antenna 100 can be selected individually to direct radiation patterns in accordance with the desires of the operator and/or the demands of subscribers. Additionally, circular metallic plates 105 and 108 can be placed at the top and bottom of the cylindrical FSS 102 to enhance the radiation performance of the antenna 100. Circular metallic plate 105 is placed between cone 103 and the top of cylindrical FSS 102. Circular metallic plate 108 is placed between cone 109 and the bottom of cylindrical FSS 102.

Figure 3:
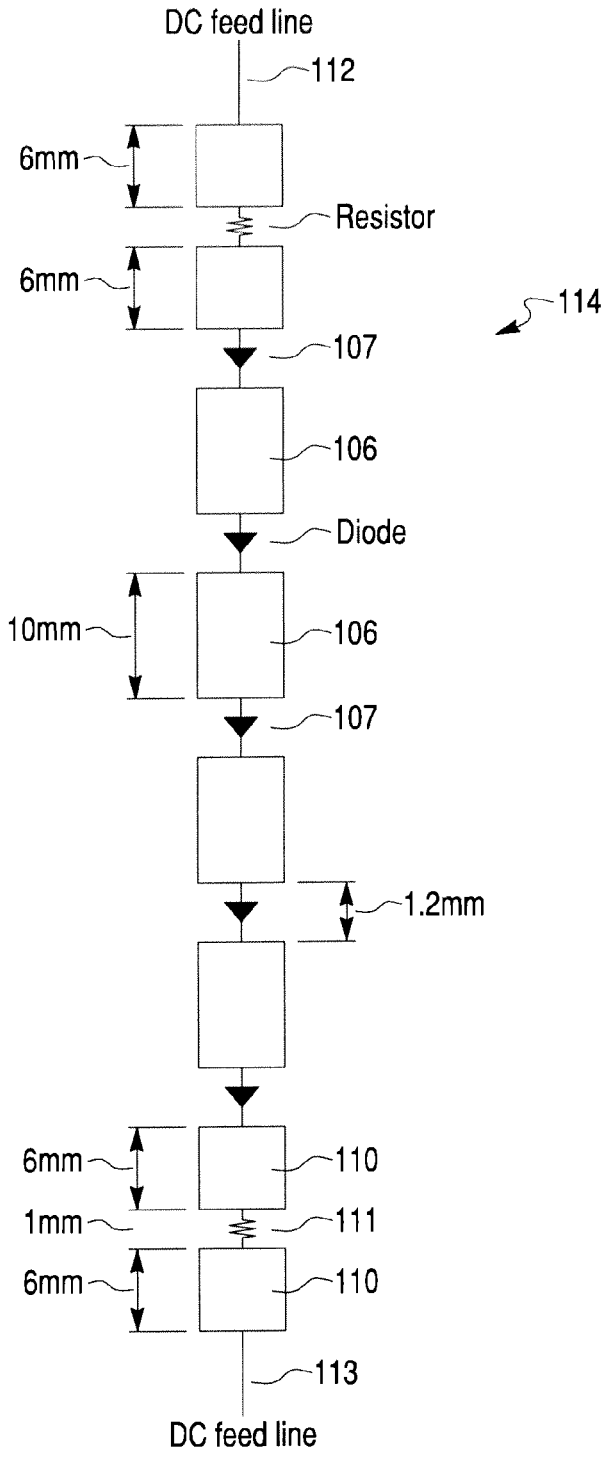
FIG. 3 is a schematic diagram of an exemplary column in the present frequency selective surface (FSS)

The frequency selective surface (FSS) 102 is a periodic structure composed of columns 114 of substantially identical elements with frequency dependent reflection and transmission coefficients. The FSS 102 is advantageously employed for directing incident electromagnetic waves. The frequency selective surface (FSS) 102 in each of the six sections of the beam switching antenna 100 comprise three columns 114 that run vertically along the length of the cylindrical FSS 102. Each column 114 preferably comprises four middle metallic strips 106, four short metallic strips 110, five PIN diodes 107, and two resistors 111. The four middle metallic strips 106 and three of the PIN diodes 107 alternate in the middle of the column 114. One PIN diode 107 is also placed at the top and bottom of the middle metallic strips 106, as shown in FIG. 1. Two of the short metallic strips 110 are placed at the top of column 114, and the other two short metallic strips 110 are placed on the bottom of the column 114. One of the resistors 111 is placed in between each set of short metallic strips 110. In the preferred embodiment, the two resistors 111 are each 5 KΩ; however it can be any high value resistor on the order of KO, for example, 11 KΩ to 9 KΩ. These resistors 111 protect the diodes 107 and supply the same amount of current to each column. The metallic strips 106 and 110, the resistors 111 and diodes 107 are preferably mounted on a flexible substrate such as RO3003 from Rogers, with a permittivity of 3, a thickness of 0.254 mm, and a loss tangent of 0.0013. High frequency PIN diodes such as GMP-4201 from Microsemi are preferably used as the diodes 107. Each column of the FSS is preferably fed separately with DC feeding lines 112 and 113 from the top and bottom. However, all three columns in each section may be fed from a common feed line. The DC power supply lines are illustrated in FIG. 3. In the preferred embodiment, the DC feeding lines are connected to a control unit. A control unit is a device or set of devices that control, manage, or command the operation of a system. Here, the control unit can be PLC, FPGA, or simply a laptop. Using a control unit, the operator can control the direction of a radiation beam with a simple command or push a button.

The number and arrangement of components described in this patent specification may be varied to suit a particular application.

Figure 2A:
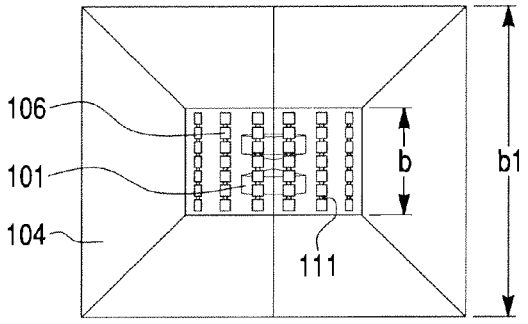
FIG. 2A is a side, see-through, view of the present beam switching antenna showing the core of the FSS cylinder.
Figure 2B:
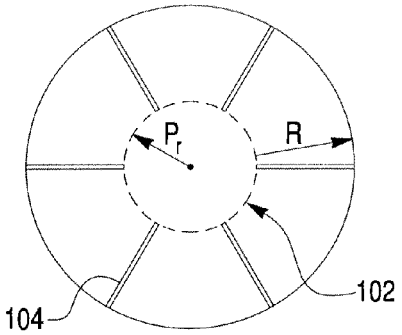
FIG. 2B is a cross sectional top view of the beam switching antenna.
Figure 2C:
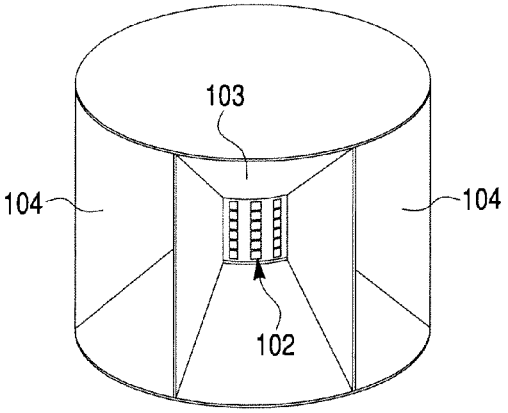
FIG. 2C is another perspective view of the present beam switching antenna.
Figure 2D:
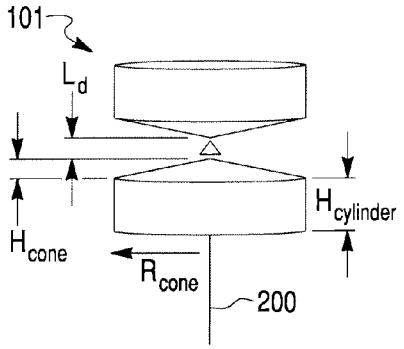
FIG. 2D is a side view of the dipole antenna that is in the core of the present beam switching antenna.

The dipole in the center of the cylindrical FSS is preferably fed through coaxial cable from the bottom of the structure (shown in FIG. 2D). The other end of the coaxial cable is connected to cellular transceiver hardware for sending and receiving RF signals, known to those skilled in the art, and not discussed further for simplicity.

To radiate in a specific direction, the PIN diodes 107 in the FSS section facing the desired direction are turned Off, and the PIN diodes in the other sections of the antenna 100 are turned On. The FSS section with Off-state diodes has a high transmission coefficient and is almost transparent for incident electromagnetic (EM) waves radiated from the dipole in the core of the cylinder. The other FSS sections with On-state PIN diodes provide a high reflection coefficient. This means one section of the antenna 100 is open, and the other sections are closed to the propagation of EM waves. Therefore, the antenna 100 directs the main beam toward the defined Off-state section. In each of the six steps around the cylinder, 15 columns of diodes, corresponding to five unselected sections, are supplied with DC voltage to switch the diodes to the On-state. And, three columns of diodes, corresponding to the one section selected for transmission receive 0 volt from the DC power supply and have their diodes in the Off-state. If the operator wanted to transmit through two or more sections of the antenna, then the PIN diodes in the two or more sections would all be disconnected from power, so that all of the diodes in the two or more sections would be in the Off-state. However, in the preferred embodiment only one section is selected for transmission. Here, by switching the PIN diodes of each section, the main beam with 60 degree beam width switches toward the desired direction with the ability of steering over the entire 360 degree azimuth plane in six steps.

The present antenna can have two modes of operation. In the first mode, the desired direction of the main beam is known; therefore, using the control unit the diodes in the sector corresponding to the direction of radiation are Off and the rest of sectors are On. This can be easily done for example by pushing a button or type a command in a control unit. The second mode is when the desired direction of the main beam is unknown. In this case the antenna operates as a smart antenna. First, the antenna operates in the received mode. The control unit makes the antenna scan the entire azimuth plane in six steps, quickly. By comparison of received signals in all steps, a final decision about the right direction of the main beam is made and sent to a control unit (for example, the direction of the maximum received signal is determined as the right direction). Then the control unit makes the appropriate DC power distribution for the 6 sectors of diodes. It switches Off the DC power for 3 columns of strips (one sector) corresponding to the desired beam direction and switches On the rest of the diodes placed in the other five sectors.

In this design, the cylindrical active FSS operates as an agile feeding network to feed each sector at each step of beam-switching, and the radiation pattern characteristics of the antenna 100 are primarily defined by the dimensions of the metallic sheets 104, the metallic cones 103 and 109 and the metallic plates 105 and 108. Another primary effort in this design is achieving beam switching with a minimum height of the active FSS in order to minimize the number of active elements required.

The metallic sheets 104, the metallic cones 103 and 109, and the plates 105 and 108 are each preferably made of brass. However, other metals may be used for the sheets, cones and plates in other embodiments, especially other types of metal that can be formed into a thin layer, yet still be rigid to semi-rigid. The important factor is the ability to construct the sheets and cones with the exact dimensions.

FIG. 2A is a side, see-through, view of the present beam switching antenna showing the dipole 101 in the core of the FSS cylinder. The dipole 101 radiates electromagnetic waves that are blocked by FSS sections with diodes in the On state, and transmitted through the FSS section with diodes in the Off state. Metallic sheet 104 exemplifies the framing of each section of the antenna wherein, each section is bordered on left and right sides by a metallic sheet 104. The height of each metallic sheet 104 next to the FSS cylinder is equal to the height of the cylinder, b. The height of the sheet 104 increases as the sheet extends away from the cylinder, so that the sheet maintains contact with the top and bottom cones. The sheet 104 terminates upon reaching the base of each cone, so that the sheet has a final height of b1. Metallic strips 106 and PIN diodes 107 of the frequency selective surface are also illustrated. The metallic planes, or plates, that are on the top and bottom of the FSS cylinder are also shown. In the preferred embodiment, the height of the FSS cylinder, b, equals 76 millimeters (mm), and the height of the sheet, b1, equals 190 mm.

FIG. 2B is a cross sectional top view of the present beam switching antenna. The cylindrical frequency selective surface (FSS) 102 comprises eighteen discontinuous columns of strips, shown as dashes in the figure that run the length of the cylinder. The cylindrical FSS 102 is divided into six sections by six metallic sheets 104, thereby providing three discontinuous columns in each section of the antenna. The sheets 104 extend outwardly from the FSS 102 a distance of R, wherein in the preferred embodiment R equals 75 mm. Further, in the preferred embodiment, the cylindrical FSS 102 has a radius of Pr, wherein Pr equals 45 mm.

FIG. 2C is another perspective view of the present beam switching antenna. Metallic cone 103 is at the top of the antenna to increase the directivity of the antenna. Frequency selective surface (FSS) 102 is in the middle of the antenna, to selectively open and close sections for transmission, and metallic sheets 104 extend outwardly from the cylindrical FSS 102. A second metallic cone is provided at the bottom of the antenna to further enhance directivity of the antenna.

FIG. 2D is a side view of the dipole antenna 101 that is in the core of the present beam switching antenna. The dipole antenna comprises two identical conductive elements pointing toward each other, with each conductive element comprising a cylinder portion and a cone portion. In the preferred embodiment, the height of each cone portion is 3 millimeters (mm), the height of each cylinder portion is 8 mm, the radius of each conductive element is 15 mm, and the gap between the two cones is 4 mm. Also in the preferred embodiment, the dipole antenna 101 is fed via a coaxial cable 200 from the bottom of the dipole antenna 101 and exits through the metallic plate 108 in the bottom of the beam switching antenna 100.

FIG. 3 is a schematic diagram of an exemplary column 114 that is repeated around the dipole and makes the present cylindrical frequency selective surface (FSS). Three of these columns 114 are provided in each section of the antenna, meaning a total of eighteen columns are provided in the entire antenna. Each column 114 starts at the top with DC feed line 112. The feed line 112 connects to the first of the short metallic strips 110. The short metallic strips 110 are preferably 6 millimeters (mm) in length. Two short metallic strips 110 are at the top of each column, and a second set of two short metallic strips 110 are provided at the bottom of each column 114. The first of two resistors 111 is located between the two short metallic strips 110 located at the top of the column 114. After the second short metallic strip 110 is the first of five PIN diodes 107. The five PIN diodes 107 and middle four metallic strips 106 alternate with each other through the middle of the column 114. In the preferred embodiment, the middle metallic strips 106 are 10 mm in length and the PIN diodes 107 are 1.2 mm in length. After the last diode 107 is the second set of short metallic strips 110 at the bottom of the column 114. The second of the two resistors 111 is located between the second set of short metallic strips 110. The last short metallic strip is connected to the DC feed line 113 located at the bottom of the column 114. This column 114 is a basic building block of the present frequency selective surface (FSS). By repeating this low cost, single layer material around the dipole to create a cylinder, an extremely efficient and highly controllable beam switching mechanism is provided. The three columns in any section of the antenna provide a high transmission coefficient for that section when the diodes are in the Off state. The same columns can also provide a high reflection coefficient when the diodes in the columns are in the On state.

Each PIN diode can be modeled with an equivalent RC circuit with an On-state resistor (here Ron=2.3Ω), and an Off-state parallel RC circuit (here $R_{off}$=30 KΩ and $C_{off}$=180 fF). The gap dimension is substantially equal to the diode dimension. In the preferred embodiment, the diode dimension is 1.2 mm. The electromagnetic (EM) plane wave radiated from the dipole propagates in the Z direction and illuminates the structure with the E-field parallel to the columns of strips (Y direction). The dimension of the column 114 is defined based on minimizing the number of active elements with the best radiation performance. The metallic strips are preferably ½ oz. (17 μm) electrodeposited copper (0.5 ED/0.5 ED). The metallic strip material is dependent on the substrate used. In the preferred embodiment, the substrate is RO3003, and the metal cladding is copper.

Figure 4:
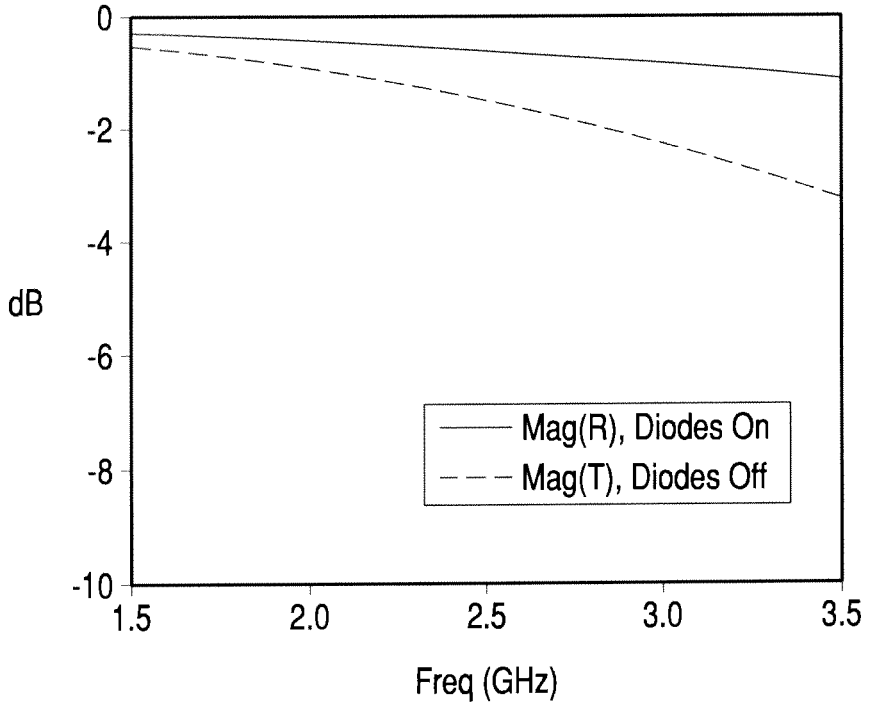
FIG. 4 is a graph showing the reflection coefficient of an On state unit cell, and the transmission coefficient of an Off state unit cell.

FIG. 4 is a graph showing the reflection coefficient of an On state unit cell, and the transmission coefficient of an Off state unit cell. The magnitude of the transmission (T) and reflection (R) coefficients of the FSS unit cell presented in the graph show that in the low frequencies, the FSS has a high reflection coefficient in the On-state and a high transmission coefficient in the Off-state. Thereby making the FSS ideal for controlling the direction of EM propagation from the antenna.

Figure 5:
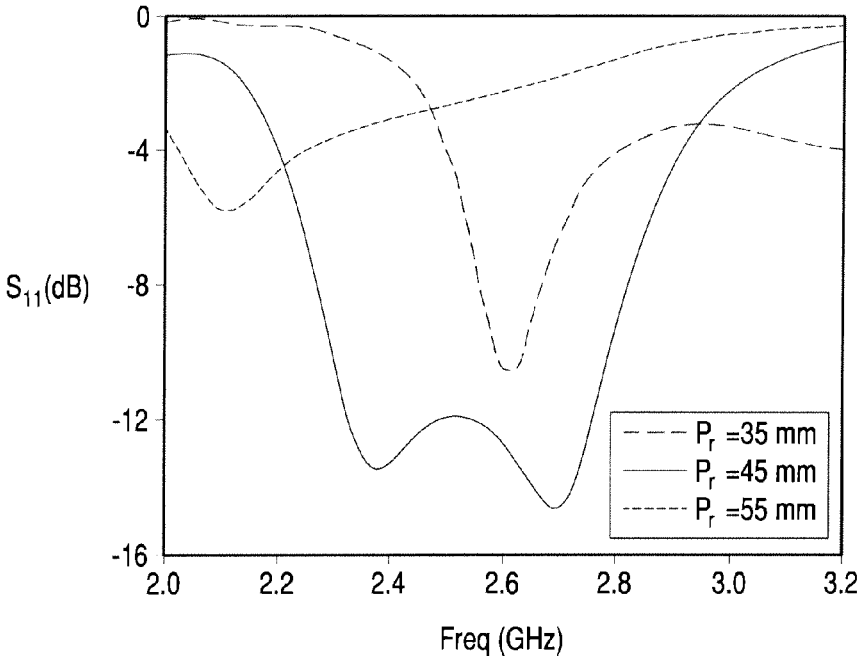
FIG. 5 is a graph showing the effect of radius of the cylindrical FSS on antenna matching.

FIG. 5 is a graph showing the effect of the radius of the cylindrical FSS on antenna matching. The matching of the antenna is primarily affected by the radius of the cylindrical active FSS. As can be seen in FIG. 5, by changing the radius of the cylindrical FSS, the matching of the antenna can be modified. A matching band of 20% is achieved ($S_{11}$<−6 dB) with a radius of 0.37λ at 2.5 GHz.

Figure 6:
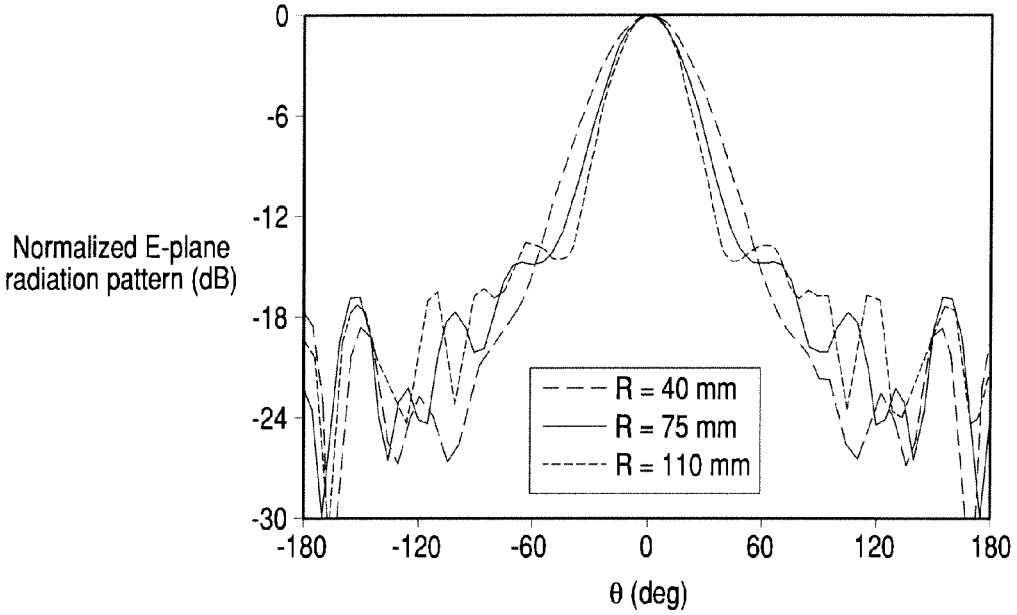
FIG. 6 shows the effect of radius of a metallic cone on the E-plane radiation pattern at 2.5 GHz.
Figure 7:
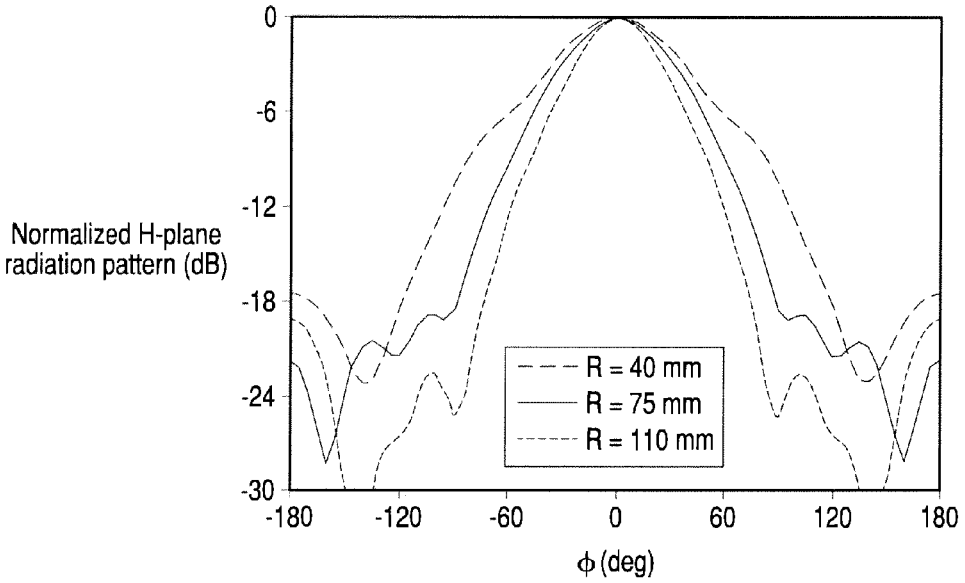
FIG. 7 is a graph showing the effect of radius of the cone on the H-plane radiation pattern at 2.5 GHz.

The antenna radiation pattern is primarily determined by the metallic cones, metallic sheets, and metallic plates shown in FIGS. 1 and 2. The effect of the radius (R) of the metallic cone on the E and H-plane radiation patterns of the antenna are illustrated in FIG. 6 and FIG. 7, respectively. As shown in the figures, by changing the radius of the cone, the radiation beam width and back-lobe of the antenna in the E- and H-planes are modified. FIG. 6 shows the effect of the radius (R) of the metallic cone on the E-plane radiation pattern, at 2.5 GHz. The value of the parameter R mostly affects the H-plane radiation pattern. FIG. 7 is a graph showing the effect of the radius of the cone on the H-plane radiation pattern, at 2.5 GHz. By increasing the R value, the H-plane radiation beam width decreases due to increasing the radiating aperture in the H-plane direction. In this design, the 3-dB radiation beam width of the antenna in the H-plane should be equal to 60 degrees in order to have the full coverage of the entire azimuth plane in six steps and to avoid any blindness in scanning. As shown in FIG. 7, an H-plane beam width of 60 degree is achieved with R=75 mm, which has also the lowest back-lobe level.

Figure 8:
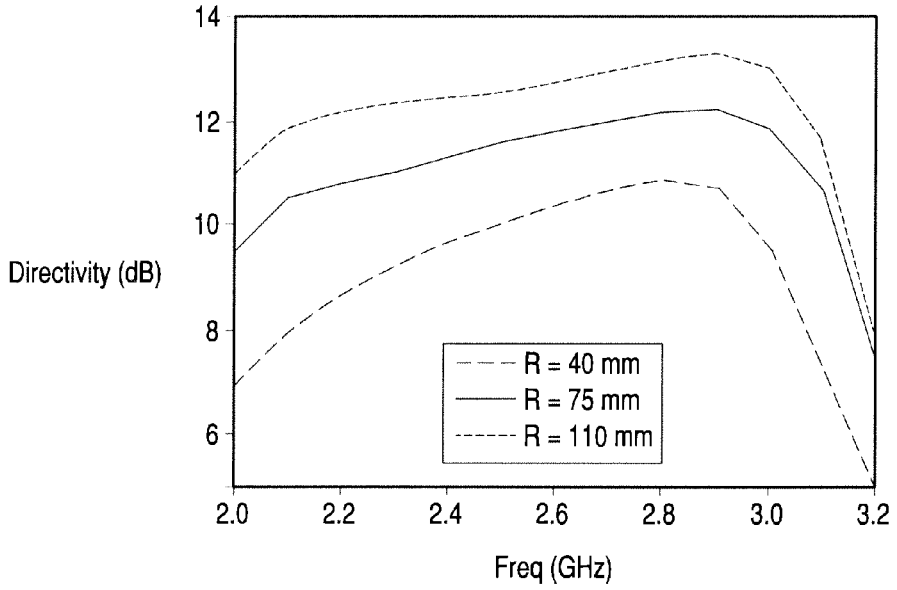
FIG. 8 is a graph showing the effect of the radius of the cone on the antenna directivity.

FIG. 8 is a graph showing the effect of the radius of the cone on the antenna directivity. The directivity of the antenna versus frequency for various values of R is shown in the figure. By increasing the radius (R) of the metallic cone the antenna directivity is increased due to the increasing of the radiating aperture.

Figure 9:
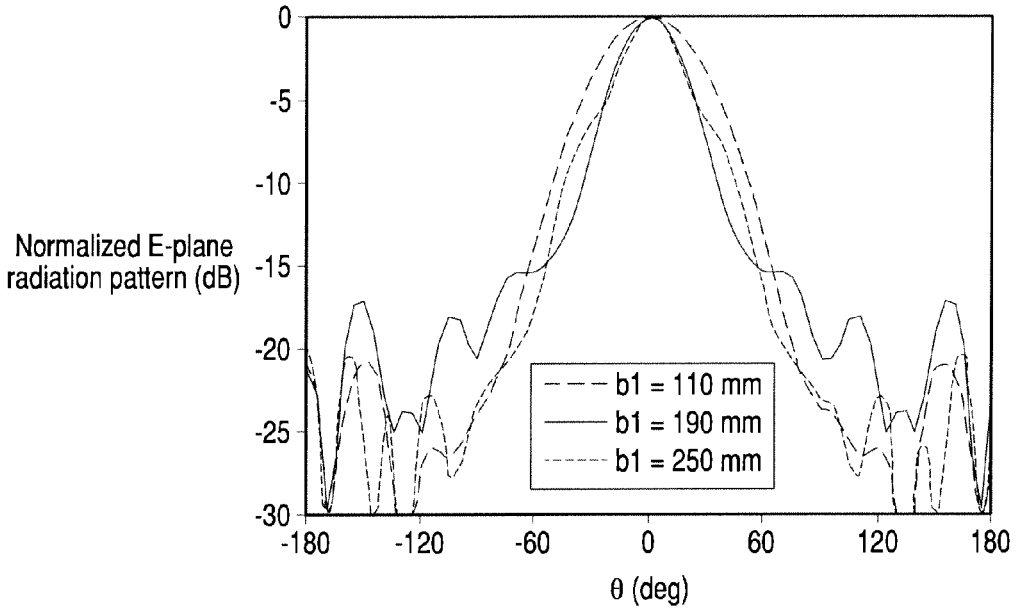
FIG. 9 shows the effect of the height of the metallic sheet on the E-plane radiation pattern of the antenna.
Figure 10:
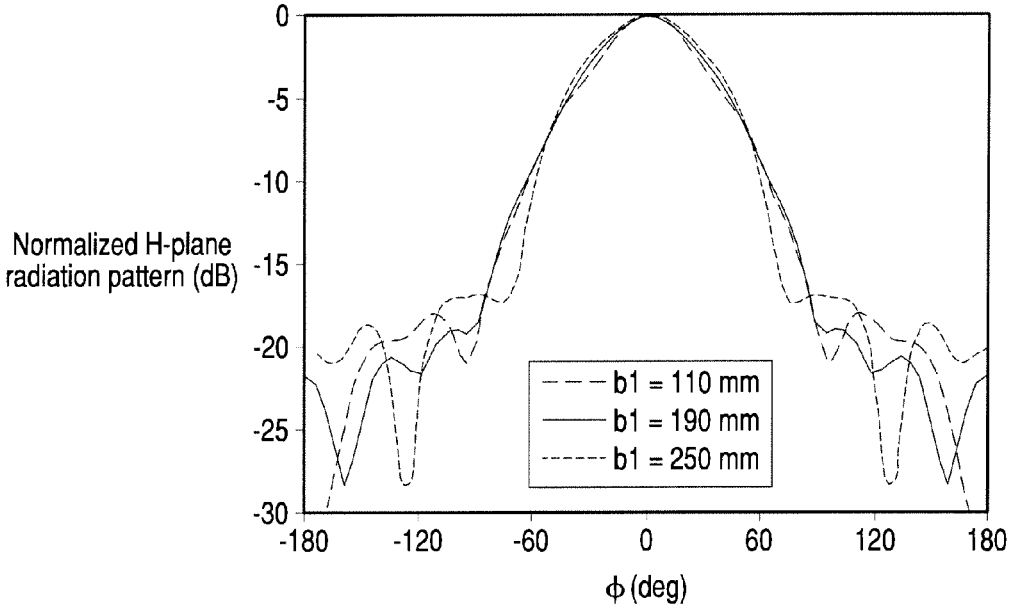
FIG. 10 is a graph showing the effect of the height of the metallic sheet on the H-plane radiation pattern of the antenna.

Another important design parameter which defines the radiating aperture and radiation pattern of the antenna is the height of the metallic sheet, b1, shown in FIG. 2A. The effects of the height of the metallic sheet, b1, on the radiation patterns of the antenna in the E- and H-plane are shown in FIG. 9 and FIG. 10, respectively. FIG. 9 shows the effect of the height of the metallic sheet on the E-plane radiation pattern of the antenna. FIG. 10 is a graph showing the effect of the height of the metallic sheet on the H-plane radiation pattern of the antenna. The variation of b1 mainly affects the E-plane radiation pattern. Increasing the height of the metallic cone decreases the E-plane radiation beam width until the optimum size. Increasing b1 more than the optimum value, not only does not decrease the E-plane radiation beam width, but also the side lobes start increasing, especially at the higher frequencies. Therefore the antenna directivity is decreased.

Figure 11:
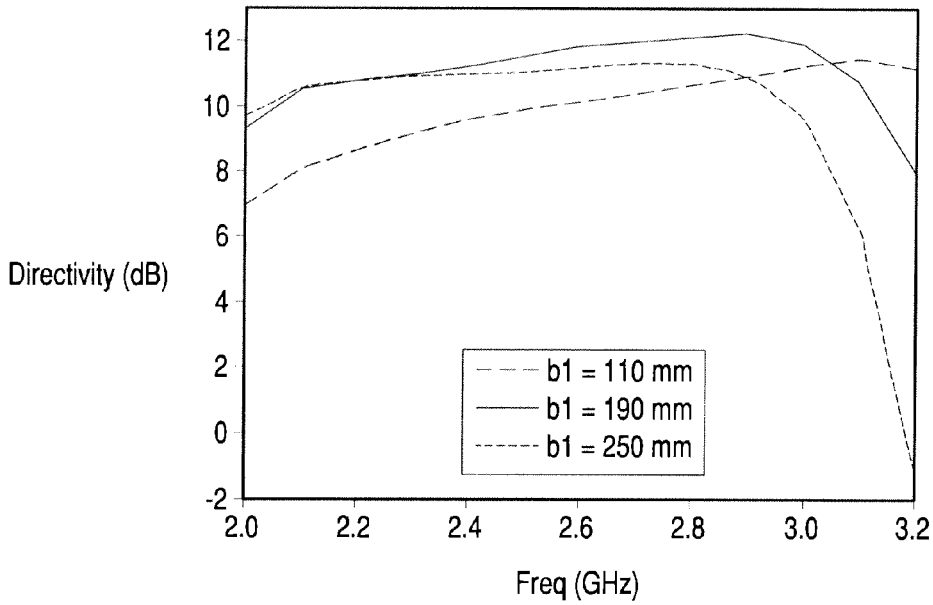
FIG. 11 is a graph showing the effect of the height of the metallic sheet on the antenna directivity.

The effect of the height, b1, of the metallic sheet on the directivity of the antenna is presented in FIG. 11. The graph of FIG. 11 shows the highest directivity, which is 11.5 dB at 2.5 GHz, and the widest directivity bandwidth is achieved at 190 mm. The higher value of b1 at higher frequency creates higher side lobes and lower directivity.

Figure 12:
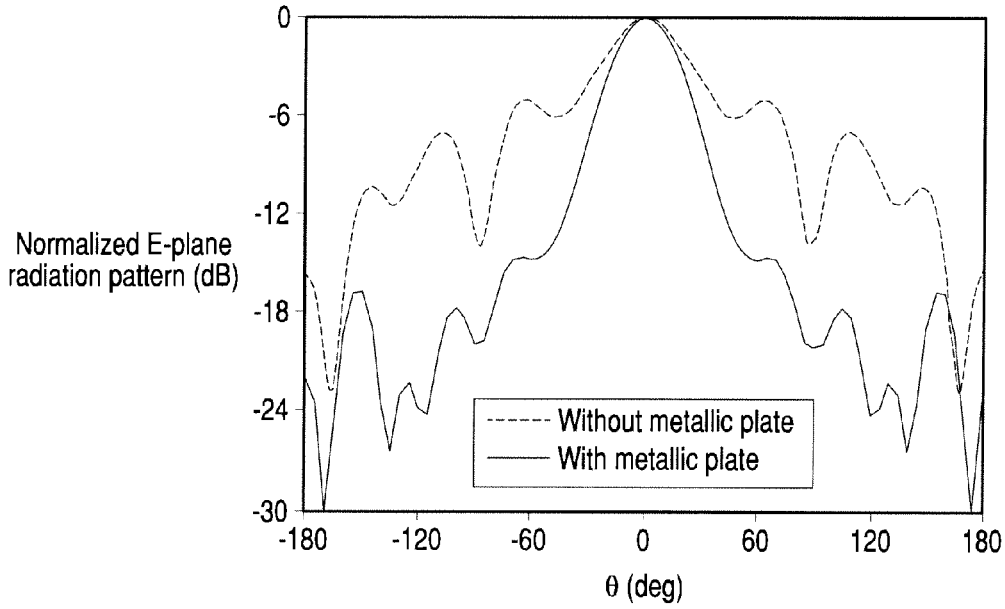
FIG. 12 shows the effect of the metallic plates on the E-plane radiation pattern of the antenna.
Figure 13:
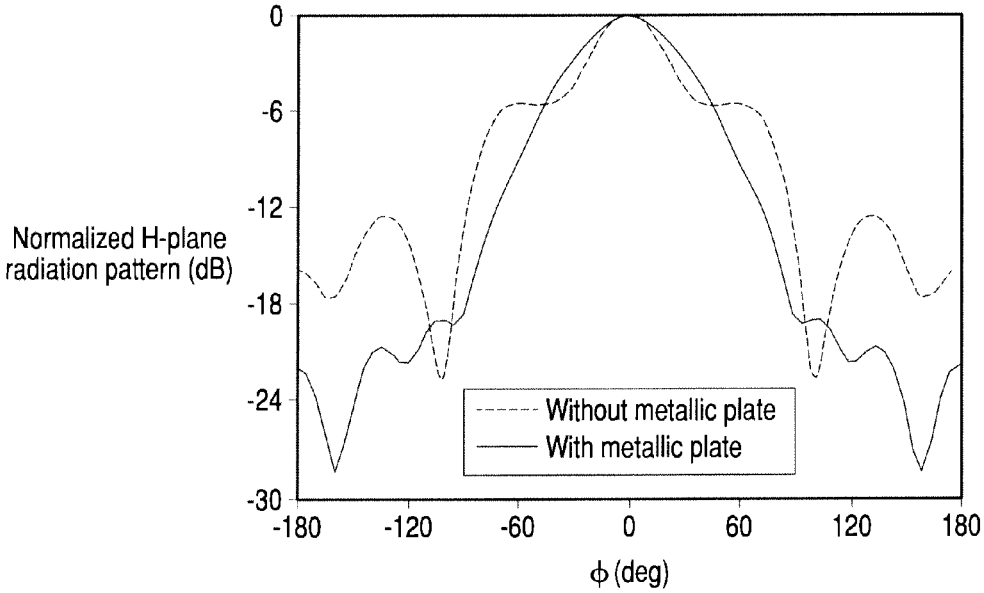
FIG. 13 is a graph showing the effect of the metallic plates on the H-plane radiation pattern of the antenna.

As the height of the cylindrical FSS is short compared to the dipole dimensions, there is a leakage of the radiated power at the top and bottom of the FSS. Therefore, the metallic plates at the top and bottom of the cylindrical FSS are used to enhance radiation performances of the antenna. The effect of the metallic plates on the E- and H-plane radiation patterns of the antenna are shown in FIG. 12 and FIG. 13. FIG. 12 is a graph showing the effect of the metallic plates on the E-plane radiation pattern of the antenna. FIG. 13 shows the effect of the metallic plates on the H-plane radiation pattern of the antenna. As it is presented, the metallic plates decrease the side-lobes of the antenna to −15 dB and back-lobes to −22 dB. From the parametric studies, the circular metallic plates and metallic cones have important roles which achieve the desired radiation patterns with the shortest possible height of the cylindrical FSS, and the minimum number of active elements. Otherwise, to achieve the desired radiation pattern, one would have to increase the height of the FSS which would require increasing the number of active elements. Further, it is also shown in the figures that the active cylindrical FSS primarily determines the antenna matching.

Figure 14:
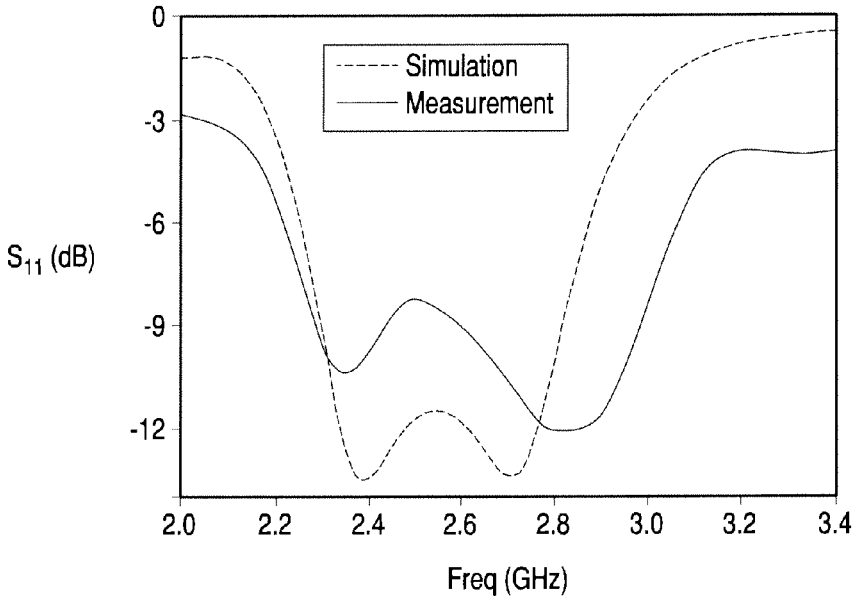
FIG. 14 is a graph showing S11 of the present antenna simulated and measured results.

FIG. 14 is a graph showing $S_{11}$ of the present antenna, simulated and measured results. According to the measurement result, the antenna is matched from 2.2 GHz to 3 GHz with matching bandwidth of 30%. The measured $S_{11}$ is 10% wider than the simulated results. The difference between simulated and measured $S_{11}$ is partly due to the fabrication and measurement errors. In addition, in the simulation, the dipole antenna is excited by a discrete port between its two arms, however, in the fabricated prototype, the dipole is fed with coaxial cable from the top of the structure, which can explain some of the discrepancies observed between the full-wave simulation and measured results.

Figure 15:
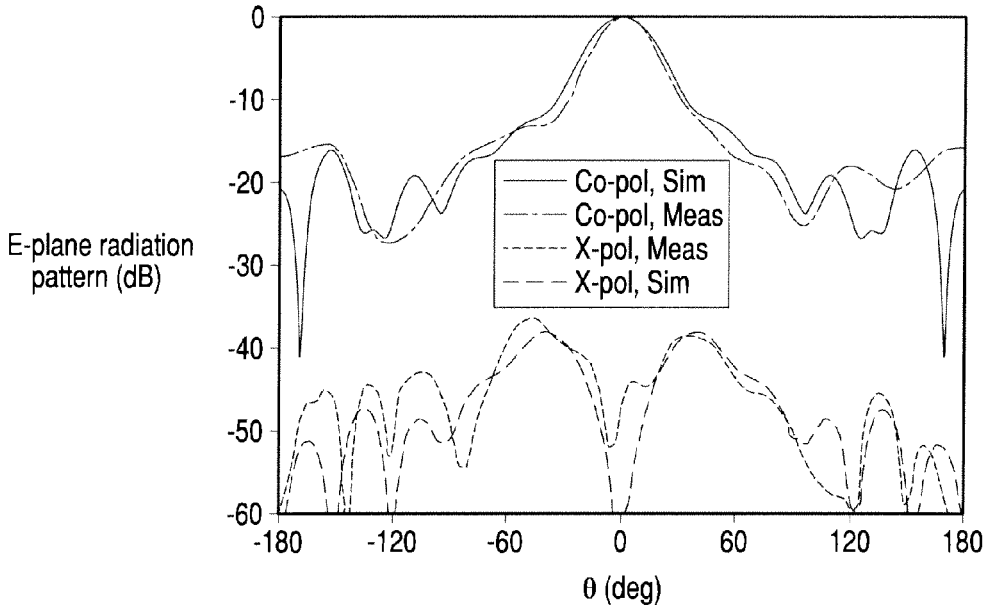
FIG. 15 is a graph showing measured and simulated E-plane radiation pattern of the antenna at 2.5 GHz.
Figure 16:
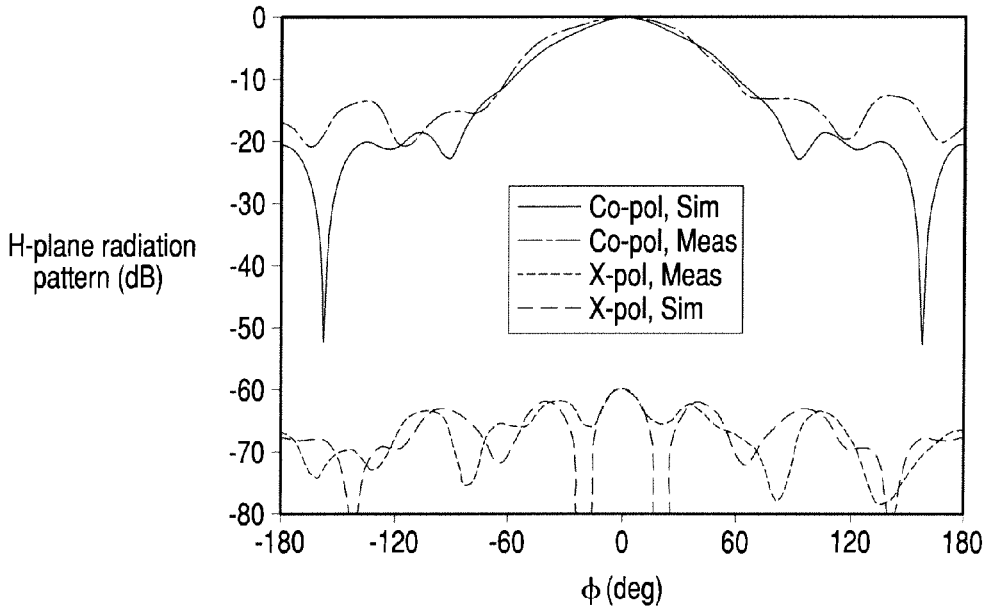
FIG. 16 is a graph showing measured and simulated H-plane radiation pattern of the antenna at 2.5 GHz.

The co-polarization and cross-polarization radiation patterns of the antenna were measured in an anechoic chamber. The E- and H-plane radiation patterns at 2.5 GHz are shown in FIG. 15 and FIG. 16. FIG. 15 is a graph showing measured and simulated E-plane radiation pattern of the antenna at 2.5 GHz. The 3-dB beam width of the antenna in the elevation plane is 30 degrees, whereas the azimuth beam width is 60 degree, and both agree well with the simulations. The antenna has a back-lobe level of −18 dB and a side-lobe level of −15 dB. FIG. 16 is a graph showing measured and simulated H-plane radiation pattern of the antenna at 2.5 GHz. The antenna polarization is linear in the vertical direction due to the dipole antenna in the center of the structure. The maximum measured cross-polarization level of the antenna in the E-plane is −40 dB lower than the co-polarization, whereas the maximum measured cross-polarization level of the antenna in the H-plane is −60 dB lower than the co-polarization level.

Figure 17:
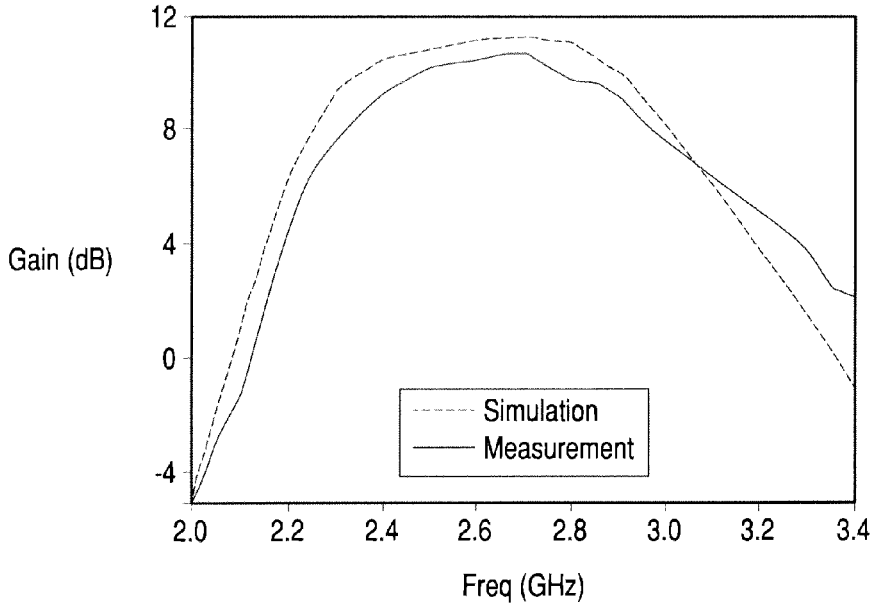
FIG. 17 is a graph showing measured and simulated gain of the antenna.

The gain of the antenna was measured using the gain comparison method. FIG. 17 is a graph showing measured and simulated gain of the antenna. The measured gain of the antenna is about 10 dBi and agrees well with the simulated results.

Figure 18A:
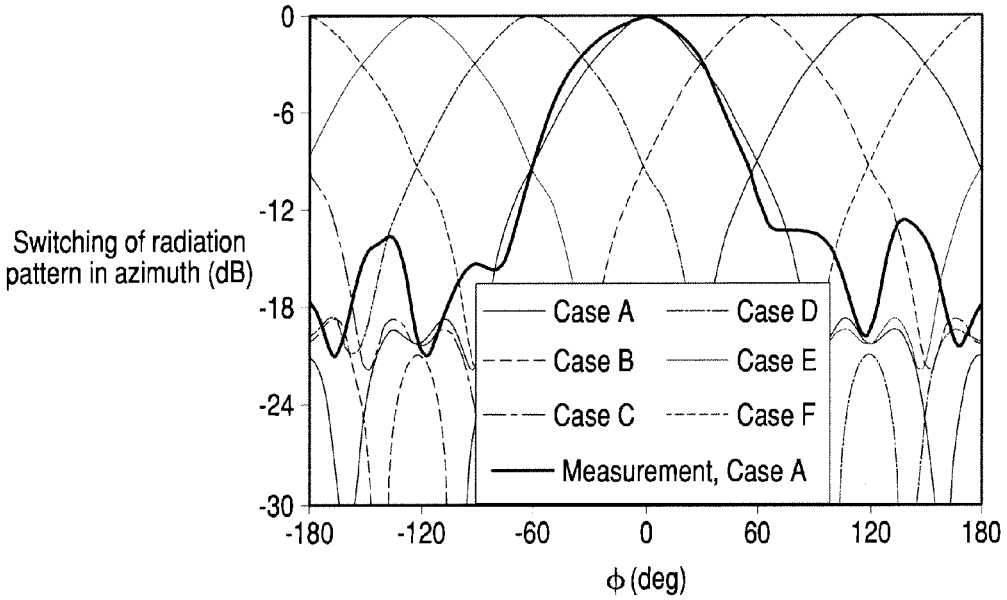
FIG. 18A is a graph showing beam switching properties of the antenna, radiation patterns in the azimuth plane.
Figure 18B:
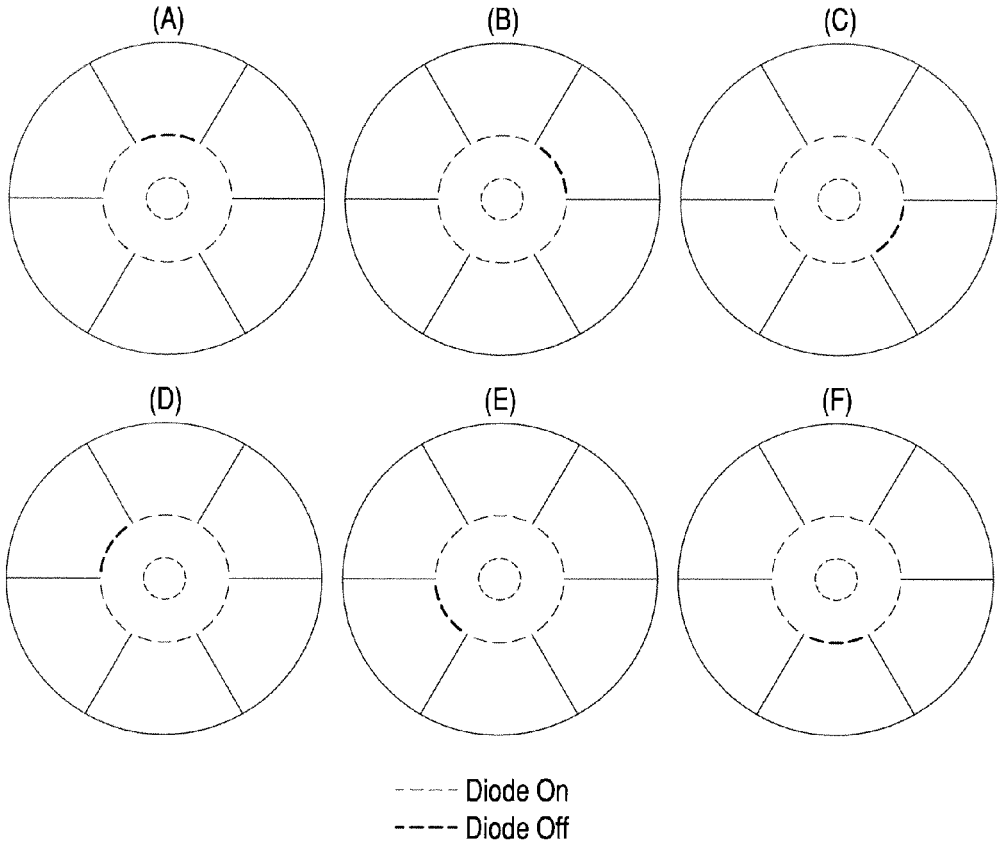
FIG. 18B comprises six top cross sectional views of the antenna, showing the six different diode configurations for beam switching.

FIG. 18A is a graph showing beam switching properties of the antenna radiation patterns in the azimuth plane. The figure shows the beam-switching characteristic of the antenna with simulated H-plane radiation patterns for switching the beam in six steps of 60 degrees. The radiation patterns in the six steps are corresponding to the diode-state configurations shown in FIG. 18B. FIG. 18B comprises six top cross sectional views of the antenna, showing the six different diode configurations for beam switching. The simulated radiation pattern for case (A) is compared with the measured one, and the results closely resemble each other. As the fabricated prototype in the azimuth plane has cylindrical symmetry, it can be concluded that the other cases also give the same performance as the simulation. Each dash in each section of the antenna, shown in FIG. 18B represents one column of frequency selective material. Dashes that are in BOLD represent columns with their diodes in the Off state. Dashes that are not in bold represent columns that have their diodes in the On state.

Figure 19:
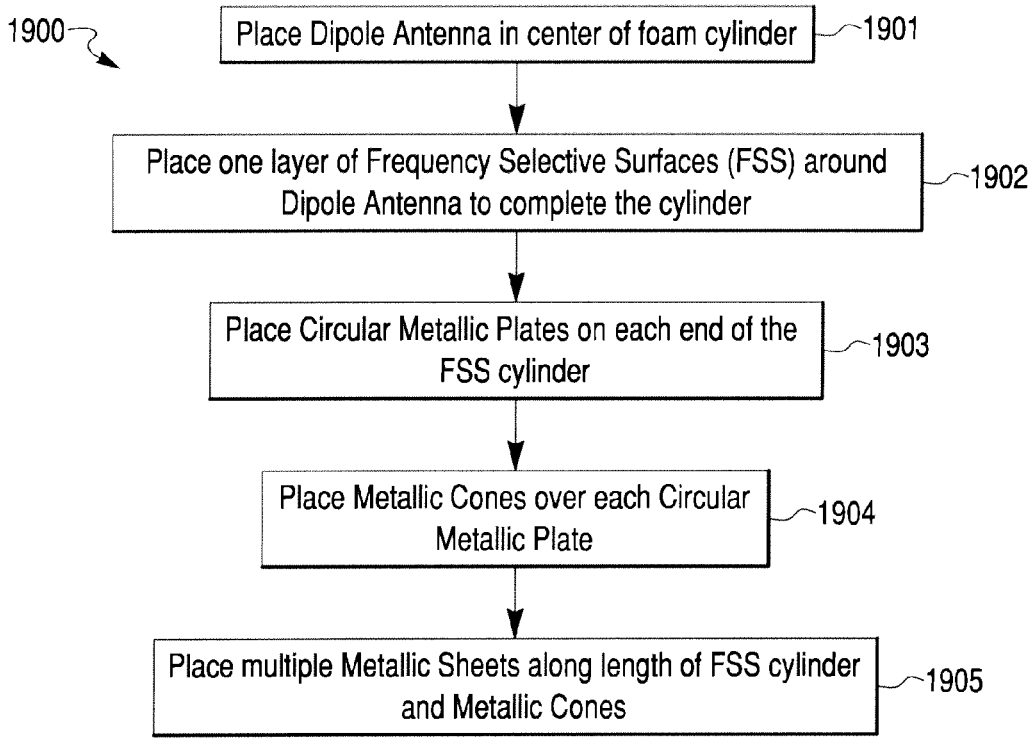
FIG. 19 is a flow chart illustrating exemplary steps in a method for making the present beam switching antenna.

FIG. 19 is a flow chart illustrating exemplary steps in a method 1900 for making the present beam switching antenna. The first step 1901 is to place a dipole antenna in the center of the cylinder. The dipole can be kept and fixed in the center of the FSS cylinder with styrofoam which has a permittivity close to the permittivity of the air; therefore, it does not have any effect on the performance of the antenna. In step 1902, one layer of cylindrical frequency selective surface (FSS) is placed around the dipole to complete the cylinder. The FSSs are preferably constructed in columns, with eight metal strips, five diodes and two resistors in each column, and eighteen columns are placed around the dipole to complete the cylinder. In step 1903, metallic plates are placed over the top and bottom of the cylinder. The metallic plate preferably has a radius substantially equal to the radius of the cylinder. As discussed above, the metallic plates are used to enhance the radiation patterns of the antenna. In step 1904, a metallic cone is placed over each metallic plate, thereby providing a spindle like shape to the antenna. The radius of the small end, or "tip", of each cone is substantially equal to the radius of the cylinder and of the plates. The radius of the large end, or base, of the cone is 120 mm in the preferred embodiment. The height of the cones is dictated by the height of the metallic sheets that divide the antenna into sections. In step 1905, the metallic sheets are added to the exterior of the cylinder and cones. In the preferred embodiment, six sheets are used to divide the antenna into six separate sections, wherein three columns of the FSSs are provided in each of the sections. The width of the sheet is dictated by the radius of the base of the cones. In the preferred embodiment, the height of each sheet is 190 mm.

Figure 20:
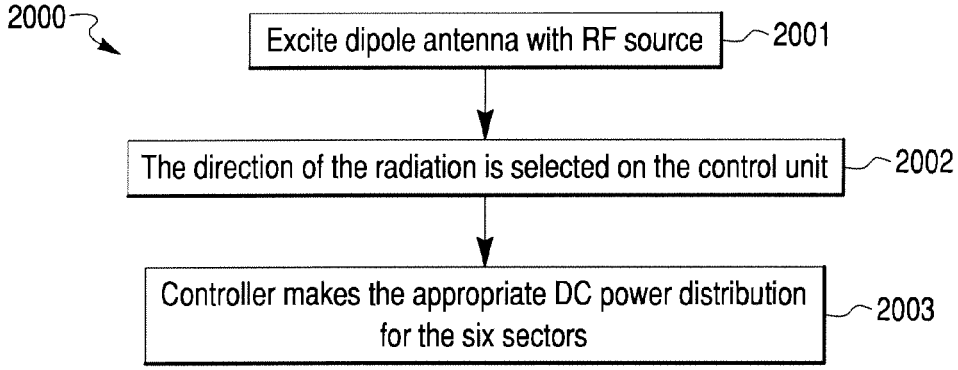
FIG. 20 is a flow chart illustrating exemplary steps in a method for using the present beam switching antenna in a first mode, when the direction of radiation is known.

FIG. 20 is a flow chart illustrating exemplary steps in a method 2000 for using the present beam switching antenna in a first mode of operation when the desired direction of the radiation is known. In step 2001, the dipole antenna is excited by a RF source. In step 2002, the direction of the radiation is selected on a control unit that is connected to the antenna. In step 2003, the diodes in the sector in which the operator wishes to transmit/receive the signal, receive 0 Volt DC (switch diodes Off), and all diodes in all other sectors receive V Volt DC (switch diodes On), where V is a positive or negative number depending on the diode's orientation. Thus, five sections of the antenna, and the seventy-five diodes in the five sections, are switched to their On state. All of the diodes in the one selected section are turned Off. Thus, the fifteen diodes in the one section selected for transmission are switched to their Off state. Providing the ability to selectively transmit/receive in any direction has uses in many areas, including indoor wireless LAN systems, base station applications, radars, and in tactical situations for the military to provide directional transmissions/reception.

Figure 21:
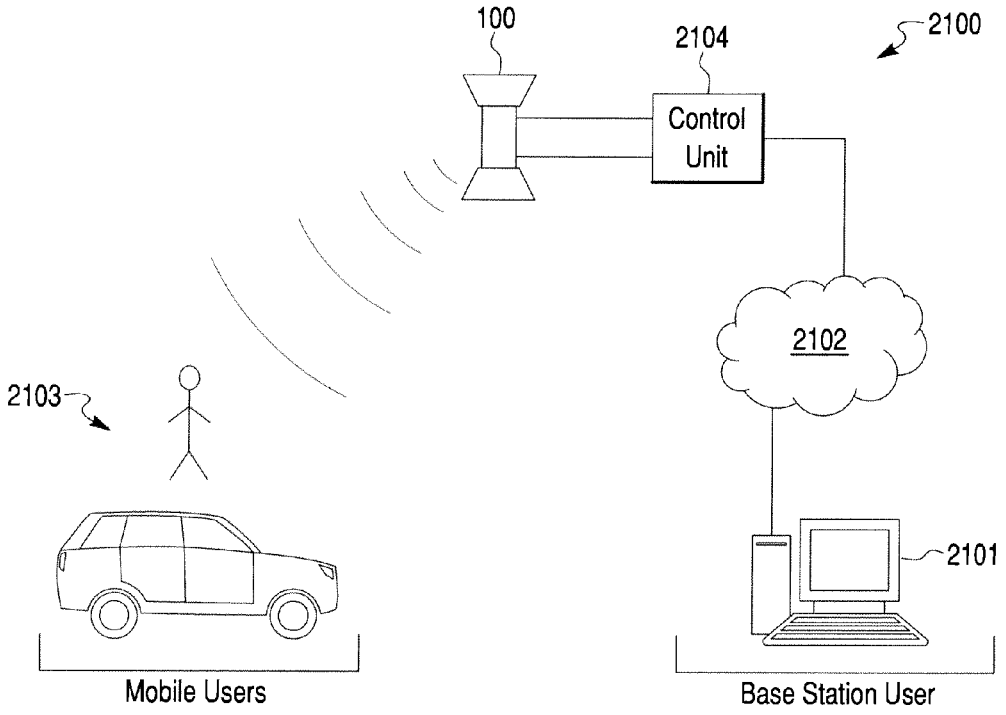
FIG. 21 illustrates an exemplary system that uses the present beam switching antenna.

FIG. 21 illustrates an exemplary system 2100 that uses the present beam switching antenna 100. The antenna 100 may be positioned on a roof top or tower, and is connected to a control unit 2104. The control unit 2104 is in turn connected via a wired or wireless network 2102 to a computer 2101, at a base station. The DC power is provided by a DC power supply. The high value resistors and the PIN diode determine the required DC current and voltage. Here, for this specific PIN diode, a DC current of between 1 mA to 2 mA is required for each column of strip to turn the diodes On. Since in each column two resistors with resistivity of R=5KΩ are used, the required voltage for this particular embodiment is about 15 Volt which supplies a current of 1.5 mA for each diode. The RF source can be any RF signal at the frequency of 2.2 GHz to 3.2 GHz (operating frequency of the dipole). The RF signal may contain information required for sending/receiving. The antenna 100 receives signals from the subscribers 2103 and using one or more sweeps of a complete 360 degrees, the system 2100 determines location data of the subscribers 2103. The subscribers may be, for example, individuals with cell phones or vehicle communication equipment. The system 2100 uses the location data of the subscribers 2103 to determine the appropriate configuration for the antenna 100. The available configurations for the preferred embodiment are illustrated in FIG. 18B. The selected configuration is sent to the antenna 100. The configuration data acts as control data for turning diodes Off, in the section of the selected direction, and turning diodes On, in all other sections of the antenna. Through selective application of power, the present antenna 100 can be controlled from almost any remote location. System 2100 preferably includes an antenna control program for controlling the antenna based on subscriber distribution, and a graphical user interface for accepting input from an operator and displaying output to the operator. FIG. 21 illustrates only one application of the invention and many other arrangements are contemplated.

Figure 22:
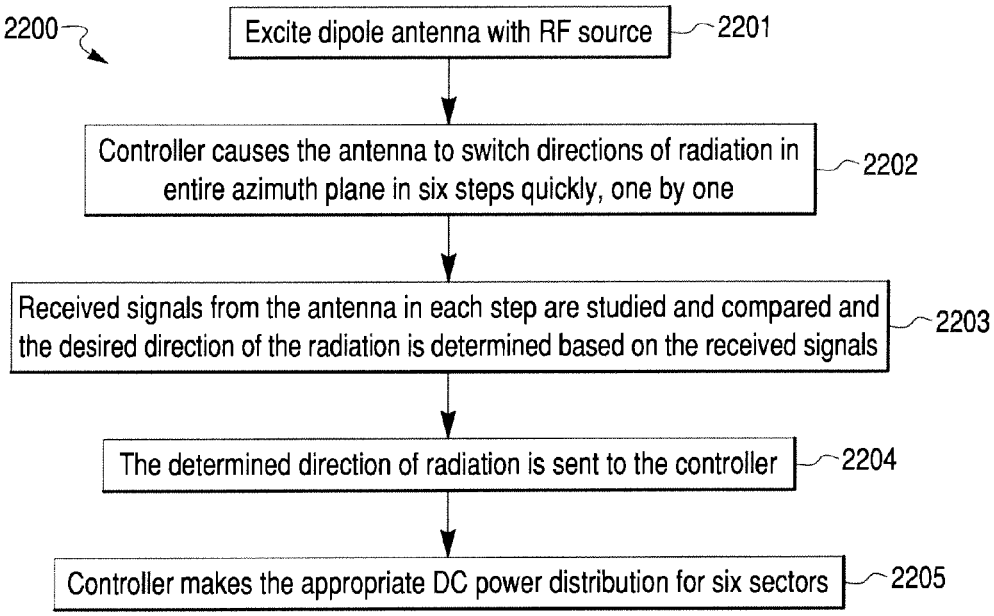
FIG. 22 shows exemplary steps in a method for using an embodiment of the present beam switching antenna in a second mode, when the direction of the radiation is unknown; and, FIG. 23 is another exemplary system wherein the present antenna may operate in the first or second mode.

FIG. 22 is a flow chart illustrating exemplary steps in a method 2200 for using the present beam switching antenna in the second mode of operation, when the desired direction of the radiation is unknown. In step 2201, a radio frequency (RF) source is used to excite the dipole antenna. In step 2202, an antenna controller causes the antenna to switch the direction of the radiation over the entire azimuth plane. The antenna completes this scan in six quick steps, one by one. In step 2203, the signals received by the antenna in each step are studied and compared and the appropriate direction of radiation is determined based on the received signals (e.g. the direction of the maximum received signal is determined as the appropriate or desired direction). In step 2204, data associated with the determined direction of radiation is sent to the controller. In step 2205, the controller makes the appropriate DC power distribution for the six sectors. The diodes corresponding to the sector in the direction of the radiation (placed in 3 columns) receive 0 volt DC and switch OFF, and the other diodes in the 15 columns of the unselected sections receive V volt DC, and switch ON.

Figure 23:
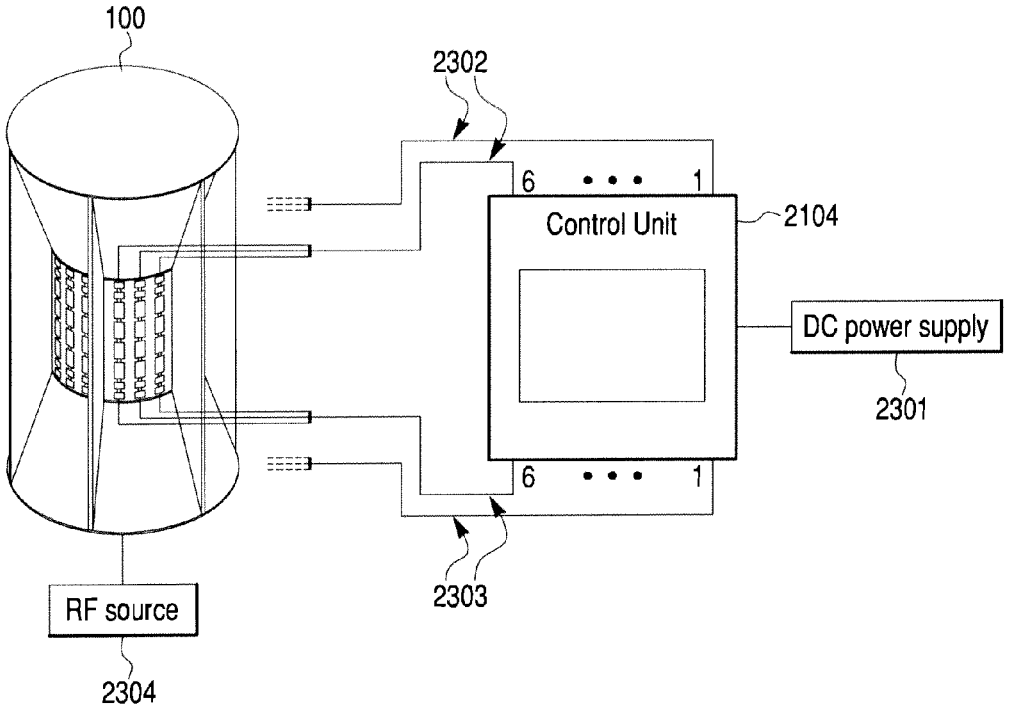

FIG. 23 shows another exemplary system wherein the antenna 100 operates in the first or second modes of operation. Power supply unit 2301 provides DC power to antenna 100 via control unit 2104. The control unit 2104 uses dedicated DC feeding lines 2302 and 2303 to selectively provide current to the six individual sections of the antenna 100. Each DC feeding line 2302, 2303 is divided into three DC feeding lines wherein each one feeds one column of strips. When the dipole inside antenna 100 is excited by radio frequency (RF) source 2304, the radio waves are transmitted in the direction selected by the control unit 2104. In this exemplary embodiment, one button is provided on the face of the control unit 2104 for each section in the antenna 100 for a total of six buttons. Of course, this is only exemplary and in other embodiments the control unit can be a FPGA (field-programmable gate array), PLC (programmable logic controller) or a computer.

The foregoing description of some embodiments reveals the general nature of the invention so that others can readily modify and/or adapt to various applications without departing from the concepts. For example, more or less metallic sheets can be used to divide the antenna into more or less than six sections. Therefore, such adaptations and modifications are included within the scope of the invention defined with reference to the claims.

We claim:

1. A directable antenna, the directable antenna comprising:

an omnidirectional antenna at a center of the directable antenna;

a frequency selective surface that surrounds the center, the frequency selective surface comprising multiple columns of frequency selective material;

a first metallic plate located at a first end of the frequency selective surface perpendicular to an axis of the frequency selective surface;

a second metallic plate located at a second end of the frequency selective surface perpendicular to the axis of the frequency selective surface;

a first cone extending away from the first metallic plate; and a second cone extending away from the second metallic plate;

wherein the frequency selective surface is divided into at least two sections, the at least two sections comprising frequency selective material that allows a section of the at least two sections to either block or allow transmission of electromagnetic waves, depending on a state of active elements.

2. A directable antenna as set forth in claim 1, wherein all sections of the at least two sections comprise a resistor at a top or bottom of a column of the multiple columns.

3. A directable antenna as set forth in claim 2, wherein the resistor is positioned between two metallic strips.

4. A directable antenna as set forth in claim 3, wherein the metallic strips are made of copper.

5. A directable antenna as set forth in claim 1, wherein all sections of the at least two sections comprise a resistor at a top of a column of the multiple columns and a resistor at a bottom of the column.

6. A directable antenna as set forth in claim 1, further comprising multiple metallic sheets, wherein the multiple metallic sheets project outward from the frequency selective surface and the cones to provide side borders for each of the sections of the at least two sections.

7. A directable antenna as set forth in claim 6, wherein the multiple metallic sheets are made of brass.

8. A directable antenna as set forth in claim 1, wherein each column of the multiple columns comprises eight metallic strips, five PIN diodes and two resistors.

9. A directable antenna as set forth in claim 1, wherein the first metallic plate and the second metallic plate are made of brass.

10. A directable antenna as set forth in claim 1, wherein the first and second cones are made of brass.

11. A directable antenna as set forth in claim 1, wherein each column of the multiple columns within a section of the at least two sections is powered separately.

12. A directable antenna as set forth in claim 1, wherein all columns of the multiple columns within a section of the at least two sections are powered together.

13. A directable antenna system, comprising:

a directable antenna as set forth in claim 1; and an antenna control unit configured to control on and off states of active elements such that a direction of a main beam of the directable antenna is caused to vary.

14. A directable antenna system as set forth in claim 13, wherein the system is configured to perform received signal analysis on signals received by the directable antenna and vary the direction of the main beam based on the received signal analysis.

15. A directable antenna system as set forth in claim 14, wherein the system is configured to direct the main beam toward a direction of maximum signal.

16. A method of directing an antenna beam, comprising:

controlling active elements on a frequency selective surface of a directable antenna to be on or off to cause a main beam of the directable antenna to vary its position, the directable antenna having a first metallic plate located at a first end of the frequency selective surface perpendicular to an axis of the frequency selective surface and having a second metallic plate located at a second end of the frequency selective surface perpendicular to the axis of the frequency selective surface;

receiving signals with the directable antenna as the position of the main beam is varied;

analyzing the received signals; and directing the main beam based on the analyzing of the received signals.

17. A method as set forth in claim 16, wherein the directing comprises directing the main beam towards a direction of maximum signal.

18. A method as set forth in claim 16, wherein the directable antenna further comprises:

an omnidirectional antenna at a center of the directable antenna;

a first cone extending away from the first metallic plate; and a second cone extending away from the second metallic plate; and multiple metallic sheets, wherein the multiple metallic sheets project outward from the frequency selective surface and the cones.

* * * * *